United States Patent [19]

Wittrisch

[11] Patent Number: 4,738,312

[45] Date of Patent: Apr. 19, 1988

[54] CABLE CUTTING COUPLING FOR DRILLING, PRODUCTION, WELL LOGGING OR OTHER OPERATIONS IN WELLS

[75] Inventor: Christian Wittrisch, Rueil Malmaison, France

[73] Assignee: Institut Francais du Petrole, Rueil-Malmaison, France

[21] Appl. No.: 870,946

[22] Filed: Jun. 5, 1986

[30] Foreign Application Priority Data

Jun. 14, 1985 [FR] France ..... 85 09199

[51] Int. Cl.[4] ..... E21B 29/04

[52] U.S. Cl. ..... 166/54.5; 166/54.6

[58] Field of Search ..... 166/54.5, 54.6

[56] References Cited

U.S. PATENT DOCUMENTS

| | | | |
|---|---|---|---|
| 1,018,274 | 2/1912 | Sheehan et al. | 166/54.6 |
| 1,608,313 | 11/1926 | Helbert | 166/54.5 |
| 3,020,957 | 2/1962 | Tausch | 166/54.5 |
| 4,427,059 | 1/1984 | Olivier | 166/54.6 |
| 4,660,635 | 4/1987 | Wittrisch | 166/54.5 |

*Primary Examiner*—Stephen J. Novosad
*Assistant Examiner*—Bruce M. Kisliuk
*Attorney, Agent, or Firm*—Antonelli, Terry & Wands

[57] ABSTRACT

A cable cutting sub or coupling for drilling, production, well logging or troubleshooting operations in wells, comprising a drilling pipe in which a cable is engaged. This sub allowing the cable to be severed if required comprises a tubular body in which a liner may slide. The side wall of said tubular liner has an opening in which is engaged a member for severing the cable and said liner is movable from a first position offering free axial passage to the cable to a second position in which an internal shoulder of said liner urges the cable against said severing member.

11 Claims, 2 Drawing Sheets

CABLE CUTTING COUPLING FOR DRILLING, PRODUCTION, WELL LOGGING OR OTHER OPERATIONS IN WELLS

BACKGROUND OF THE INVENTION

1. Field of the Invention

The present invention relates to a cable cutting device, e.g., a coupling which may be incorporated in a pipe in which a cable is engaged for drilling, production, well logging or other operation such as servicing or troubleshooting operations, more generally any kind of works performed in wells and allowing the cable to be severed at the level of the coupling if required.

2. Description of the Prior Art

The prior art may be illustrated by the U.S. Pat. Nos. 1,610,699; 1,776,026; 3,661,207; 4,160,478; and 4,427,059.

The cable cutting coupling of the present invention may be particularly used in a drill pipe string comprising a coupling with side entry for passing the cable from the inside towards the outside of the drill pipes, with hydraulic sealing about the cable.

Side entry couplings (generally called "side entry subs" in the oil industry) are well known by specialists in oil drilling. Such a device is for example described in the British patent No. 2.135.719.

A side entry sub is, for example, used in the technique described in French patent No. 2.501.777 (EN 81/05.271) and its first two additions EN. 82/03.317 and EN. 84/08.369.

In this technique, for carrying out well logging or troubleshooting in horizontal or steeply slanted wells, a well logging probe or a troubleshooting tool is initially fixed to the lower part of a drill string which is lowered into the well as it is formed.

Then an electric cable is lowered inside the drill pipes (by gravity and by pumping) comprising a weighted connector (the connector has thereover a loader bar) to which is coupled a complementary connector fixed to the top of the probe (or tool). In the portion of the drill string corresponding to the vertical part or slightly slanting part of the well, a side entry sub allows the cable to be passed from the inside to the outside of the drill pipes.

The recording of the measurement (or the troubleshooting) in the well) is effected by moving the whole of the drill string from the surface.

Present equipment comprising a side entry sub raise a problem however in the case of jamming of the drill string in the well.

In fact, because of the presence of the electric cable inside the drill pipes in the part between the side entry sub and the load bar troubleshooting cannot be carried out for releasing the drill string.

These release operations or work consists for example in introducing into the drill pipe, from the surface, specialized tools which must be lowered by means of a cable as far as the zone (which is generally situated under the side entry sub) which comprises the drill pipes jammed by the formation. These specialized tools may for example be an explosive which allows the jammed drill pipe to be unscrewed.

Furthermore, the presence of the cable inside the drill string, above the side entry sub, limits the possibilities of rotation of the drill string.

SUMMARY OR THE INVENTION

The essential object of the invention is to allow severing of the cable just above the load bar in equipment of the above described type.

The cable portion situated above the load bar may then be raised to the surface, whereas the load bar falls by gravity inside the drill pipes.

It may then, if necessary, be moved by pumping to the upper end of the drill string.

The invention is also applicable in the case of an oil well eruption, when the drill string comprises a side entry sub situated under the turn table, this sub serving for passing a cable therethrough.

It is in fact necessary in this case to be able to raise the cable situated inside the drill string, above the side entry sub, so as to be able to control closure of the blow out preventer stack about the pipes from the surface. In this application, the invention aims at allowing the cable to be severed in the vicinity of the side entry sub, thus allowing the cable portion situated above this sub to be raised before closure of the jaws of the preventer stack about the drill pipes.

The objective mentioned above may be attained in accordance with the invention, with a cable cutting sub which may be incorporated in a pipe in which a cable is engaged for drilling, production, well logging or troubleshooting operations in wells and allowing, if need be, the cable to be severed at the level of a sub, this sub comprising a tubular body in which a liner may slide, wherein the side wall of said tubular liner has an opening in which is engaged a member for severing the cable and said liner is movable from a first position offering free passage to the cable, to a second position in which the member is actuated to press the cable against an internal shoulder of said liner.

Said member for severing the cable may comprise a pivoting finger articulated in a housing in the internal wall of the tubular body.

The invention relates more particularly to cable cutting subs such as difined above in which said first and second positions of said tubular liner are formed respectively by a low position and a high position, said liner having at its lower part a restriction of its internal diameter, cooperating with a piece fixed to the cable or an extra thick portion thereof below the sub, so as to cause said liner to pass from its first position to its second position under the action of a pull exerted on the cable and directed from top to bottom, this pull causing self clamping of the cable between said internal shoulder of the liner and said severing member. This embodiment is particularly advantageous.

In a variant of the particularly advantageous embodiment, the cable cutting sub comprises a low stop and a high stop for said liner, a return spring urging said liner to its low stop and at least one shearable pin holding said liner in its low position.

This sub advantageously comprises guide means for guiding the sliding of said liner, these guide means comprising at least one angular keying finger engaged in a guide groove.

BRIEF DESCRIPTION OF THE DRAWINGS

Embodiments of the invention are illustrated in the accompanying drawings in which.

DESCRIPTION OF THE PREFERRED EMBODIMENTS

In the Figures, reference 1 designates as a whole the cable cutting device, e.g., a sub or coupling, of the invention screwed between two tubular elements such as 1*a* and 1*b* of the drill pipe string.

Figure 1:
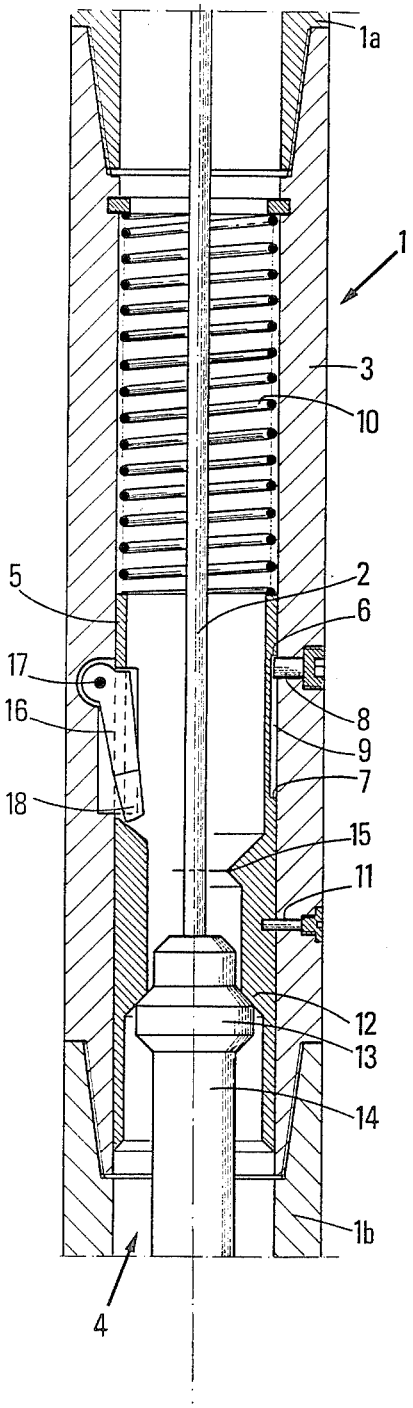
FIG. 1 shows a cable cutting sub of the invention in its low position.

Reference 2 designates a cable engaged in the drill pipe string and the lower part of which ends in an electric connector or load bar designated as a whole by the reference 4. This cable passes for example from the outside towards the inside of the drill pipe string through a side entry sub 1*c* (FIGS. 3, 4 and 5) which is not shown in FIGS. 1 and 2.

Cable 2 is, for example, of a type used for well logging or troubleshooting contructed in accordance with the technique described in French patent No. 2 501 777 and its above mentioned additions.

Sub 1 comprises a tubular body 3 in which a liner 5 may slide.

The sliding liner 5 is movable between two positions defined by respectively top 6 and bottom 7 stops while being guided by means of a finger 8 integral with body 1 and engaged in a groove 9. This finger also secures the liner against rotation.

Liner 5 is normally at the top stop (FIG. 1), urged into this position by a spring 10 and held in this position by a shearable pin 11. This first position offers free axial passage to cable 2.

Liner 5 comprises at its lower part:

a restriction of diameter 12 serving as stop for the larger diameter part 13 mounted over the body 14 of the load bar 4, an internal shoulder with semicircular cutting edge 15 on which cable 2 will be applied, an arm or finger 16 pivoting about a pivot pin 17 perpendicular to the axis of body 1 whose end 18 opposite pin 17 has the form of a half circle complementary to the shape of edge 15.

Figure 2:
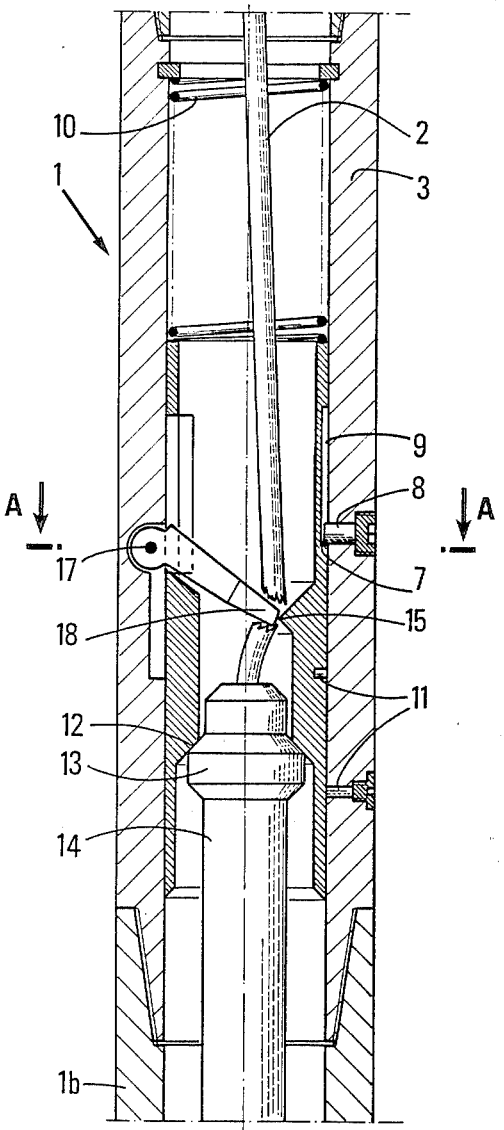
FIG. 2 shows the sub placed in a high position under the effect of an upward pull exerted on the cable, FIG. 2A corresponds to the section A of FIG. 2, and FIGS. 3, 4 and 5 show schematically several possible arrangements of the cable cutting sub of the invention in a drill string comprising a side entry sub.
Figure 2A:
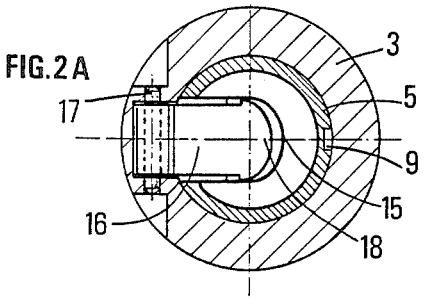

This arm moves between two positions in which it is respectively:

(a) folded back along the body (FIG. 1) and (b) slanted in the extension of edge 15 (FIG. 2).

This movement of arm 16 is caused by that of liner 5, during rising thereof due to the pull on cable 2 on the surface.

The operation of this sub is given below.

A pull exerted on cable 2 from the surface causes safety pin 11 to be sheared.

Liner 5 rises then while driving with it arm 16 which pivots and pushes cable 2 against edge 15 which may be cutting. Liner 5 goes as far as the top stop, the arm being limited in its positioned movement opposite the projecting edge (second position or top position illustrated in FIG. 2).

Under the effect of a pull exerted from the surface, cable 2 is self clamped between the pivoting arm 16 and the cutting edge 15 until a breakage point is created which will cause breakage of the cable (FIG. 2) and the fall of the load bar. The portion of cable 2 between the cable cutting sub and the surface may be wound on a winch (not shown) situated on the surface.

If required, the load bar may then be pumped so as to be moved to the upper end of the drill pipe string.

Once cable 2 is broken, spring 10 pushes liner 5 downwards. In its movement this liner drives the pivoting arm 16 which, when the liner reaches the bottom stop, is folded along the body 3, in the position illustrated in FIG. 1.

Figure 3:
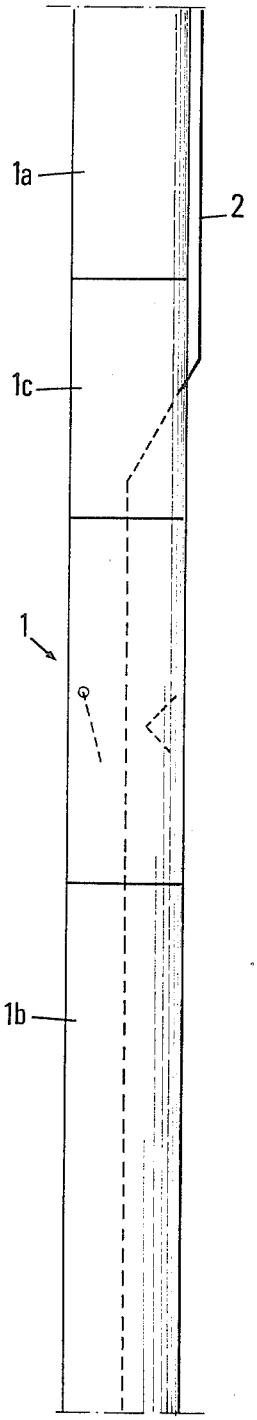
Figure 4:
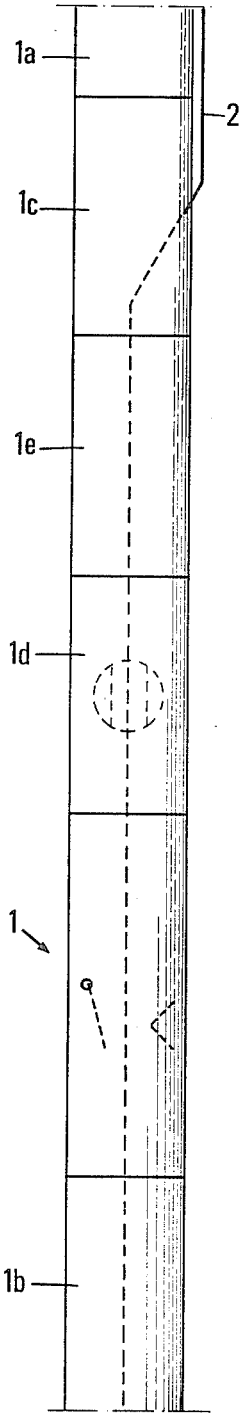
Figure 5:
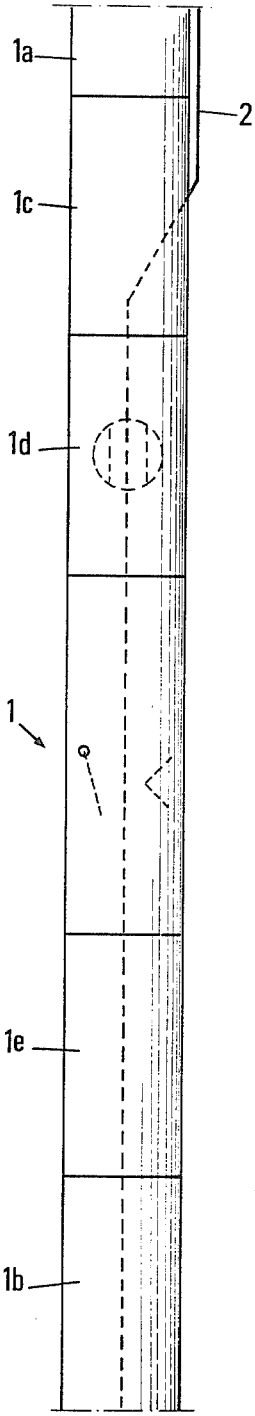

FIGS. 3 to 5 illustrate schematically by way of examples several possible arrangements of the cable cutting sub 1 of the invention in a drill pipe string comprising a side entry sub 19.

In FIGS. 4 and 5, reference 1*d* designates a safety valve and reference 1*e* a safety coupling, these two elements being of known type.

The safety subs of known types comprise a male-female thread of different pitch from those used for coupling the different elements of the drill pipe string.

Once cable 2 has been sheared and raised to the surface, this special thread will allow the drill pipe string to be unscrewed at the level of this threaded portion only, so as to raise the upper part of the drill pipe string comprising drill pipes 1*a*, the side entry sub 1*c*, the cable cutting sub 1 and the upper part of the safety sub 1a in the example of FIG. 5.

It will still be possible then to screw this safety sub 1*e* again with a drill pipe string not comprising the side entry sub 1*c*, the safety valve 1*d* and the cable cutting sub 1. The inner diameter of the drill pipe string becomes then homogeneous, which allows known procedures to be applied for unjamming the drill pipe string.

The safety valve 1*e* is generally a ball valve which is actuated manually from the outside.

In the case of eruption, after raising to the surface the part of the drill pipe string comprising the side entry sub 1*c* (FIG. 5) the blow out preventing stack is closed around the rods, then the safety valve 1*d* is closed so as to remove the side entry sub 1*c* in all safety.

Then an injection head may be screwed on and caused to circulate by pumping a fluid, for controlling the eruption of the well.

What is claimed is:

1. In a cable cutting device which may be incorporated in a pipe in which a cable is employed for drilling, production, well logging or trouble shooting operations in wells and allowing the cable to be severed at the level of the device, said device comprising a tubular body in which a liner may slide, a lateral wall of said tubular liner having an opening in which is engaged a member for severing the cable and said liner being movable from a first position offering free axial passage to the cable to a second position in which the severing member is actuated to apply the cable against an internal shoulder of said liner.

2. The cable cutting device according to claim 1 wherein said severing member comprising a pivoting finger articulated in a housing of internal wall of the tubular body and the internal shoulder comprises a cutting edge.

3. A cable cutting device according to claim 1 or claim 2, in which said first and second positions of said tubular liner are, respectively, formed by a bottom position and a top position, wherein said liner has a restriction of its internal diameter, cooperating with a portion of the cable below the device, so as to cause said liner to pass from its first position to its second position under the action of a pull exerted from bottom to top on the cable, said pull causing self clamping of the cable between said internal shoulder of the liner and said severing member.

4. The cable cutting device according to claim 3, comprising a bottom stop and a top stop for said liner, a return spring urging said liner to its bottom stop and at least a shearable pin holding said liner in its bottom position.

5. The cable cutting device according to claim 1 or claim 2, comprising means for guiding the sliding of said liner, said guide means comprising at least one angular keying finger engaged in a guide groove.

6. The cable cutting device according to claim 3 further comprising means for guiding the sliding of said liner, said guide means comprising at least one angular keying finger engaged in a guide groove.

7. The cable cutting device according to claim 4 further comprising means for guiding the sliding of said liner, said guide means comprising at least one angular keying finger engaged in a guide groove.

8. In a cable cutting device which may be incorporated in a pipe wherein a cable is employed for operation in a well and for causing the cable to be severed at the level of the device, said device comprising a tubular body in which a liner may slide, a lateral wall of said tubular liner having an opening in which is located a means for contacting the cable and said liner is movable from a first position offering free axial passage to the cable to a second position in which the means for contacting the cable is actuated to press the cable against of an internal shoulder of said liner.

9. The cable cutting device according to claim 8 wherein the internal shoulder comprises a cutting edge.

10. In a cable cutting device which may be incorporated in a pipe in which a cable is employed for operation in a well and allowing the cable to be severed at the level of the device, said device comprising a tubular body in which a liner may slide, a lateral wall of said tubular liner having an opening in which is engaged a member for severing the cable and said liner is movable from a first position offering free axial passage to the cable to a second position in which the severing member is actuated to apply the cable against an internal shoulder of said liner; said first and second positions of said tubular liner being, respectively, formed by a bottom position and a top position, wherein said liner has a restriction of its internal diameter, cooperating with a portion of the cable below the device, so as to cause said liner to pass from its first position to its second position under the action of a pull exerted from bottom to top on the cable, said pull causing self clamping of the cable between said internal shoulder of the liner and said severing member.

11. In a cable cutting device which may be incorporated in a pipe in which a cable is employed for operation in a well and allowing the cable to be severed at the level of the device, said device comprising a tubular body in which a liner may slide, a lateral wall of said tubular liner having an opening in which is engaged a member for severing the cable and said liner is movable from a first position offering free axial passage to the cable to a second position in which the severing member is actuated to apply the cable against an internal shoulder of said liner; said first and second positions of said tubular liner being, respectively, formed by a bottom position and a top position, wherein said liner has a restriction of its internal diameter, cooperating with a portion of the cable below the device, so as to cause said liner to pass from its first position to its second position under the action of a pull exerted from bottom to top on the cable, said pull causing self clamping of the cable between said internal shoulder of the liner and said severing member and a bottom stop and a top stop for said liner, a return spring urging said liner to the bottom stop and a shearable pin holding said liner in the bottom position.

* * * * *